US005394715A

United States Patent [19]

Guérette

[11] Patent Number: 5,394,715

[45] Date of Patent: Mar. 7, 1995

[54] RETAINING MECHANISM FOR A LIQUID DISPENSING APPARATUS VALVE

[75] Inventor: Alvin Guérette, Laval, Canada

[73] Assignees: Controles B.V.L. Ltee; B.V.L. Controls, Ltd., Canada

[21] Appl. No.: 251,509

[22] Filed: May 31, 1994

[30] Foreign Application Priority Data

Jun. 7, 1993 [CA] Canada ..... 2097901

[51] Int. Cl.[6] ..... B67D 5/33

[52] U.S. Cl. ..... 70/177; 70/180; 70/203; 70/212; 137/383; 251/90; 222/153

[58] Field of Search ..... 222/505, 1, 153; 251/90; 137/383; 70/18, 201, 203, 211, 212, 175, 176, 177, 178, 179, 180

[56] References Cited

U.S. PATENT DOCUMENTS

| | | | |
|---|---|---|---|
| 784,994 | 3/1905 | Durafort | 222/153 X |
| 999,983 | 8/1911 | Gardner | 70/178 |
| 1,197,937 | 9/1916 | Jackson | 70/212 |
| 1,359,729 | 11/1920 | Nichols | 70/211 |
| 1,380,675 | 6/1921 | Myers | 70/178 |
| 2,009,645 | 7/1935 | Barnes | 222/153 X |

FOREIGN PATENT DOCUMENTS

| | | | |
|---|---|---|---|
| 1287331 | 6/1991 | Canada . | |
| 21330 | of 1892 | United Kingdom | 137/383 |
| 10215 | of 1907 | United Kingdom | 137/383 |
| 2179628 | 3/1987 | United Kingdom | 222/153 |

*Primary Examiner*—Andres Kashnikow
*Assistant Examiner*—Kenneth Bomberg

[57] ABSTRACT

A retaining mechanism for a dispensing valve operated by a pivotal handle comprised of a retainer and a hook, the retainer having a base, a catch member and a latch member fastened to the base of the retainer, the catch member and latch member being arranged for movement relative to the base. The hook is threadably fastened to the retainer. A lock secures the catch member and latch member together.

10 Claims, 3 Drawing Sheets

RETAINING MECHANISM FOR A LIQUID DISPENSING APPARATUS VALVE

This invention relates to a retaining mechanism for application to a liquid dispensing apparatus valve. The retaining mechanism includes a hook which retains the handle of the liquid dispensing valve in closed position. The retaining mechanism includes apertures adapted to receive the shaft of a lock which enables the retainer to be locked in place by the proprietor of the liquid dispensing apparatus.

More particularly this invention relates to a retaining mechanism which may be applied to a liquid dispensing apparatus valve operated by a pivotal open and closing handle to dispense carbonated beverages, fruit juices, beer, ale and other liquids. The retaining mechanism is comprised of a retainer which is adapted to be mounted on the nut which is used to connect the liquid dispensing apparatus valve to the end of a liquid dispensing line. The retainer is comprised of a base member, a latch member and a catch member. Webs extending outwardly from the catch and latch members contain apertures adapted to receive the shaft of a lock. A hook extending forwardly from the retainer extends about the base of the handle of the pivotal dispensing mechanism when the pivotal dispensing mechanism is in closed position to prevent any motion of the handle and the pivotal liquid dispensing mechanism associated with the handle.

Previous retaining mechanisms consisting of a retaining mechanism and hook for application to a pivotal dispensing mechanism are known. One such previous retaining mechanism involved a retainer comprised of two members. Two ends of the members were permanently connected together by a pin fitting through apertures in the end of the permanently connected members. The pin through the permanently connected ends of the two members served as a common axis for opening and closing the two members of the retainer about the nut used to connect the liquid dispensing apparatus valve to the end of the liquid dispensing line. The free ends of the two members contained apertures which created a single aperture having a common axis when the opposite ends of the members were interconnected. The axis was adapted to receive the cylindrical end of one side of a standard padlock. The problem with this type of retaining mechanism is that there is frequently very little space between the retainer of the retaining mechanism and the body of the liquid dispensing device. In many situations it was not possible because of lack of space to insert the open cylindrical end of the padlock into the common axis in the interlocking ends of the retainer.

A second type of retainer comprised of two members is in use. In this second type of retainer the problem of a lack of space between the back of the retainer and the body of the liquid dispensing device was avoided by providing aligned apertures on the front of the retainer so that the U of the padlock would be in the same plane as the retainer and not have to be applied in a plane perpendicular to the plane of the retainer. One problem with this second retainer is that one of the pins used to retain the two parts of the receptacle together has to be removed when the retainer is being removed from the dispensing apparatus and such pins are frequently lost. A second problem is that the fastening mechanism for the retainer requires two pins. The apertures in the fastening mechanism are disposed some distance from one another requiring a padlock with a longer U member.

In order to overcome these problems with the prior art retainers the applicant has invented a three member retainer for a liquid dispensing apparatus valve operated by a pivoted open and close handle in which the padlock may be applied through apertures having a common axis when in closed position. The padlock when applied through the apertures is in a plane parallel to the plane extending through the center of the retainer.

One embodiment of the invention is a retaining mechanism for a dispensing valve operated by a pivotal handle comprised of a retainer and a hook, the retainer having a base, a catch member and a latch member fastened to the base of the retainer, the catch member and latch member being arranged for movement relative to the base, means for fastening the hook to the retainer, means for locking the catch member and latch member together.

In another embodiment of the invention the catch members and latch members have webs which adjoin one another when the catch member and latch member are closed. The webs forming part of the catch member and latch member contain apertures which are aligned and have a common axis when the catch member and latch member are closed.

In another embodiment of the invention the base of the retainer includes a flange adapted to secure the retainer to the dispensing valve.

In another aspect the invention relates to a method of locking a dispensing valve operated by a pivotal handle using a retainer having at least three parts and a hook, comprising the steps of opening two parts of the retainer, placing the open retainer about the dispensing valve, applying the hook to the pivotal handle, closing the parts of the retainer and locking the two moving parts of the retainer together.

Figure 1:
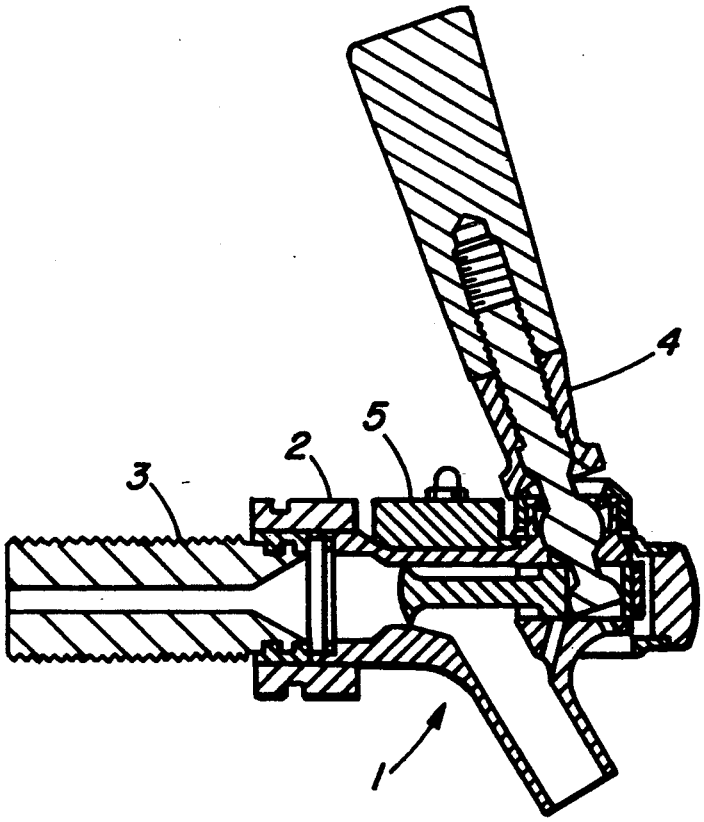
FIG. 1 is a cross-section of a dispensing apparatus valve with a pivotal handle in closed position.
Figure 2:
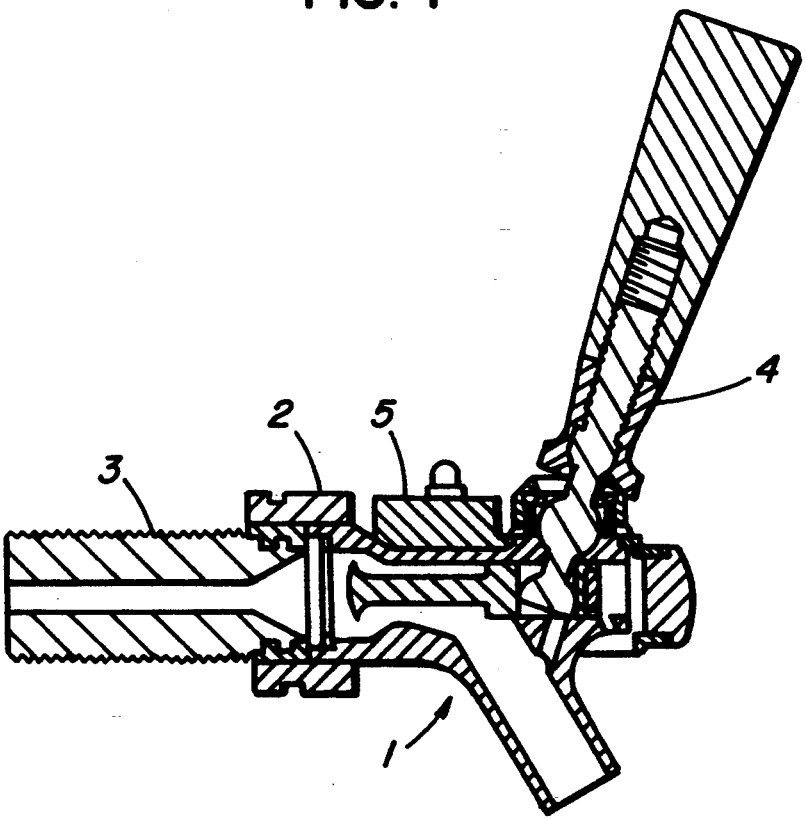
FIG. 2 is a cross-section of the dispensing apparatus valve with a pivotal handle in open position.

Referring to FIG. 1, there is shown a pivotal dispensing valve 1 which is attached by nut 2 to the end of liquid dispensing line 3. The handle 4 is inclined rearwardly closing the pivotal dispensing valve 1. The details and method of operation of the pivotal dispensing valve 1 and the portion monitor 5 are more fully described in Canadian Patent Number 1,287,331 which issued on Aug. 6, 1991. FIG. 2 shows the pivotal dispensing valve 1 with the handle 4 pulled forward opening the pivotal dispensing valve 1 to allow the flow of fluid through the pivotal dispensing valve 1.

Figure 3:
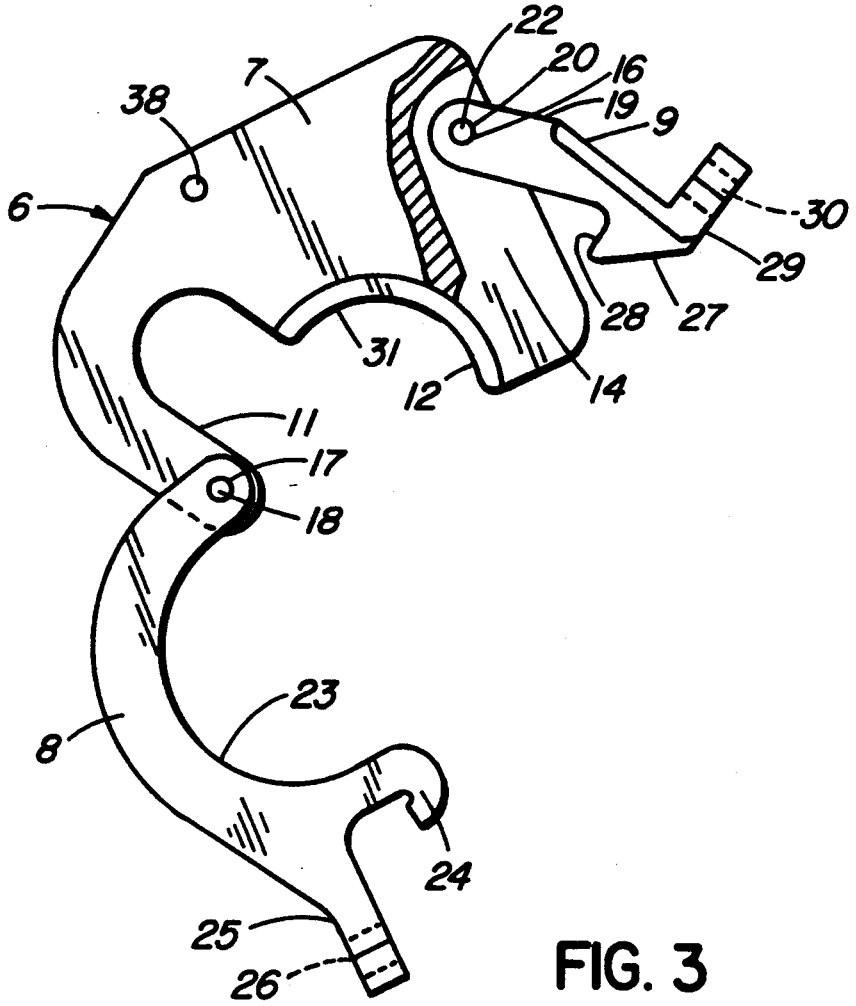
FIG. 3 is a front view of a retainer for a dispensing apparatus valve with a pivotal handle showing the retainer in open position ready for application about the lock nut connecting the dispensing apparatus valve to the product line.
Figure 6:
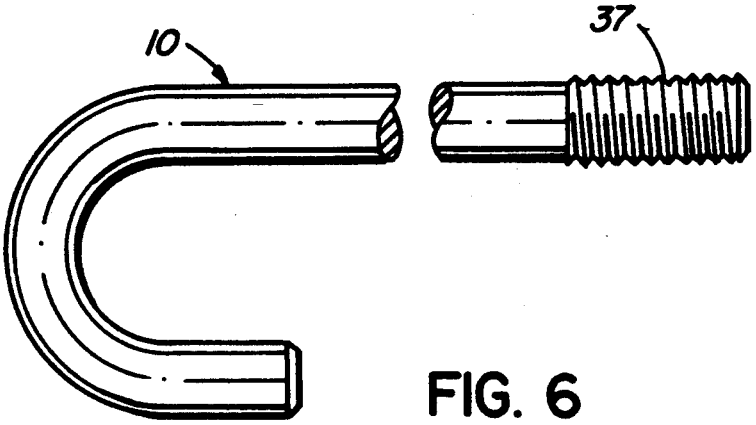
FIG. 6 is a side view of the hook which is adapted to be fastened into a threaded aperture in the base member of the retainer and extend perpendicularly therefrom.
Figure 7:
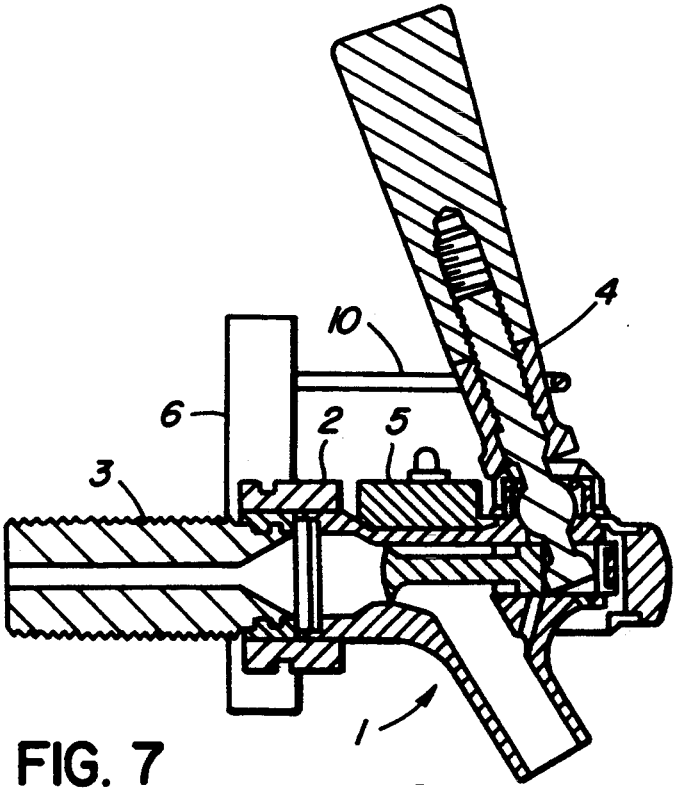
FIG. 7 is a perspective view of the dispensing apparatus valve lock of this invention applied to a dispensing apparatus valve with a pivotal handle retaining the handle in closed position.

Referring to FIG. 3, there is shown a retainer 6 which is adapted to be mounted about the nut 2 of the pivotal dispensing valve 1 shown in FIG. 1. The retainer 6 is comprised of four principal elements, a base 7, a catch member 8, a latch member 9, and a hook 10 which is shown in FIGS. 6 and 7.

Figure 4:
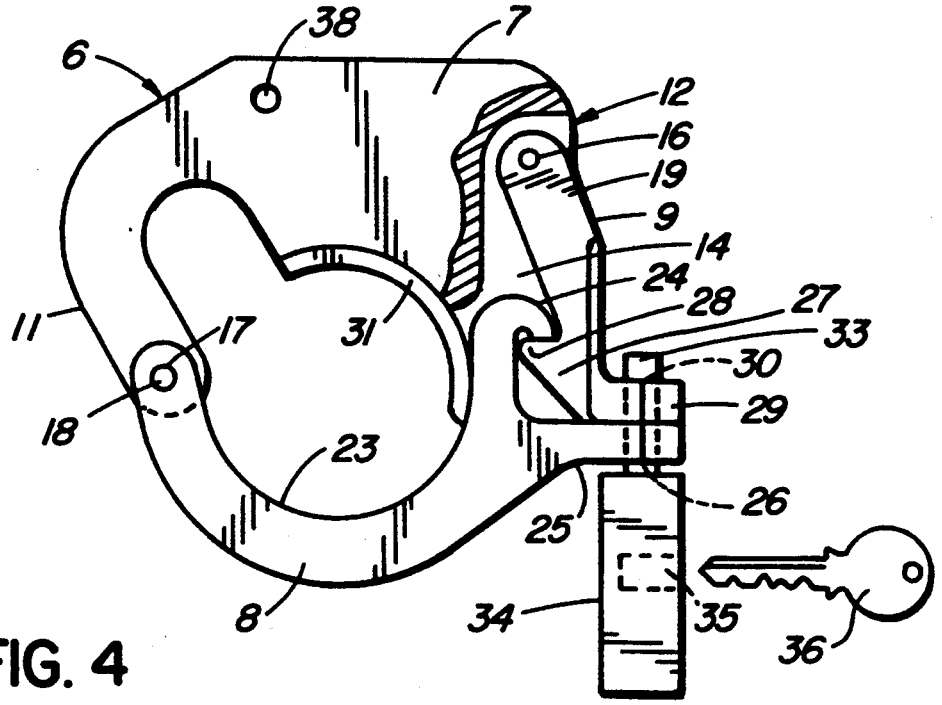
FIG. 4 is a front view of the retainer for a dispensing apparatus valve with a pivotal handle showing the retainer in a closed position.

As shown in FIGS. 3 and 4 the exterior of the base 7 of retainer 6 has a general U shape. The ends 11, 12 of the U include open slots 13, 14, seen in FIG. 5, adapted to respectively receive one end of catch member 8 and one end of latch member 9 in the respective open slots. The ends 11, 12 of the U of base 7 of retainer 6 also include apertures 15 and 16 extending perpendicularly through the ends 11, 12. The end of catch member 8 which fits into the open slot 13 likewise includes aperture 17 of corresponding size to aperture 15. A pin 18 is inserted through one end of aperture 15, through the aperture 17 in one end of catch member 8 contained in the open slot 13 near one end 11 of base 7 of retainer 6 and then through the continuation of aperture 13 in the opposite side of the end 11 of base 7 of retainer 6.

The other end 12 of the base 7 of retainer 6 contains an open slot 14 which receives one end 19 of latch member 9. The end 12 of the base 7 of retainer 6 has an aperture 20 which corresponds in size with an aperture 21 in latch member 9 A pin 22 is inserted through one end of the aperture 20, through the aperture 21 in one end of the latch member 9 which is disposed in the open slot 14 and through the continuation of aperture 20 in the other side of the end 12 of base 7 of retainer 6.

The free end 23 of catch member 8 is comprised of an outwardly facing catch 24. At some distance below the catch 24 a web 25 extends outwardly substantially perpendicularly from the catch member 8. The outer part of web 25 has an aperture 26 extending perpendicularly therethrough.

The free end 27 of latch member 9 is comprised of an inwardly facing latch 28 adapted to engage the hook 24 of catch member 8 when the catch member 8 and latch member 9 are in closed position. The latch member 9 ends in an outwardly extending web 29 having an aperture 30 extending perpendicularly therethrough. When the catch member 8 and latch member 9 are in closed position the aperture 26 in the web 25 of catch member 8 and the aperture 30 in the web 29 of latch member 9 are in line and have a common axis adapted to receive the shaft of a snap on lock.

Figure 5:
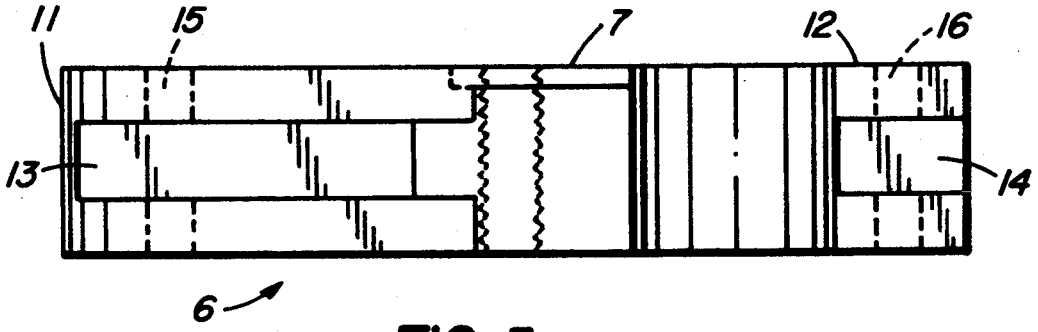
FIG. 5 is a bottom elevation view of the base member of the retainer showing the slots towards the outside of the base member for receipt near one side of the catch member and near the other side of the latch member.

Referring to FIG. 5, the slot 13 in end 11 which receives the end of catch member 8 and the slot 14 which receives the end of latch member 9 are shown as well as the respective apertures 15 and 16 which extend through the slots 13, 14.

Referring to FIG. 6 the hook 10 is shown. The hook 10 has a threaded end 37 which is screwed into the threaded aperture 38 in base 7. The effective length of hook 10 can be adjusted by threading the threaded end 37 of hook 10 into the threaded aperture 38.

The interior of base 7 of the retainer includes a narrow arcuate flange 31 extending from the rear of base 7 through an arc of approximately 120°.

In FIG. 7 the retainer 6 is shown in closed position applied to the pivotal dispensing valve 1. The manner of applying the retainer 6 to the pivotal dispensing valve 1 consists of opening the latch member 9 which pivots about the pin 22 and opening the catch member 8 which pivots about the pin 18. The base 7 of retainer 6 is lowered over the nut 2 of pivotal dispensing valve 1 in such a manner that the narrow arcuate flange 31 on the interior of base 7 engages the back of nut 2 which fastens pivotal dispensing valve 1 to the end of liquid dispensing line 3. At the same time the hook 10 is placed around the base of the handle 4 which is inclined rearwardly when the dispensing valve 1 is in closed position. The catch member 8 is then swung into position such that the catch member 8 engages the bottom of the nut 2. Holding the catch member 8 in position against the bottom of nut 2 the latch member 9 is swung towards the pivotal dispensing valve until the catch 24 and latch 28 are engaged. When the catch 24 and latch 28 are engaged the apertures 26 and 30 in the catch web 25 and latch web 29 are in line and the shaft 33 of the snap lock 34 is inserted through the apertures 26, 30 and the snap lock 34 is snapped shut.

The snap lock 34 includes a keyway 35 which is adapted to receive a key 36. When the key 36 is inserted in the keyway 35 and turned the snap lock 34 opens. The shaft 33 of the snap lock 34 is then removed from the apertures 26, 30, the latch member 9 is swung away from the nut 2 and the catch member 8 is also swung away from the nut 2. The retainer 6 and the hook 10 can then be removed from the retainer 6 and the lower part of the handle 4 respectively and the dispensing valve is available to dispense liquids.

The locking mechanism of this invention may be used by owners or managers of facilities where liquids are dispensed to lock the dispensing valves 1 when not in use. Locking of the dispensing valves prevents the dispensing valves from being accidentally or deliberately opened when the owner or manager is not present.

While the invention has been discussed with respect to a pivotal dispensing valve 1 which is connected to inlet lines 3 by a nut 2, it will be realized by those skilled in the art that the retainer disclosed in this application may be applied in a similar manner to a part of the pivotal dispensing valve behind the handle 4 such that the hook 10 may maintain the handle 4 in locked position.

I claim:

1. A retaining mechanism for a dispensing valve operated by a pivotal handle comprised of a retainer and a hook, the retainer having a base, a catch member and a latch member fastened to the base of the retainer, the catch member and latch member being arranged for movement relative to the base, means for adjustably fastening the hook to the retainer to vary the effective length of the hook relative to the retainer, and means for locking the catch member and latch member together.

2. The retaining mechanism for a dispensing valve operated by a pivotal handle of claim 1 in which the catch member and latch member have webs which adjoin one another when the catch member and latch member are closed.

3. The retaining mechanism for a dispensing valve operated by a pivotal handle of claim 2 in which the webs forming part of the catch member and latch member contain apertures which are aligned and have a common axis when the catch member and latch member are closed.

4. The retaining mechanism for a dispensing valve operated by a pivotal handle of claim 3 wherein said means for locking comprises a lock having a shaft which may be inserted through the apertures in the web of the catch and latch members.

5. The retaining mechanism for a dispensing valve operated by a pivotal handle of claim 4 in which the base of the retainer includes a flange adapted to secure the retainer to the dispensing valve.

6. The retaining mechanism for a dispensing valve operated by a pivotal handle of claim 1 in which the retainer has an aperture adapted to receive and retain the hook.

7. The retaining mechanism for a dispensing valve operated by a pivotal handle of claim 6 in which the hook is disposed substantially perpendicularly relative to a surface of the base of the retainer.

8. The retaining mechanism for a dispensing valve operated by a pivotal handle of claim 1 in which the catch member and latch member are connected to opposite portions of the base by pins.

9. A method of locking a dispensing valve operated by a pivotal handle using a retainer having at least three parts and a hook, comprising the steps of opening two parts of the retainer, placing the open retainer about the dispensing valve, applying the hook to the pivotal handle, closing the turn parts of the retainer and locking the two moving parts of the retainer together by means of the third part and a lock.

10. The method of claim 9 in which the three parts of the retainer are comprised of a base, a catch member and a latch member.

* * * * *